US008955845B2

(12) United States Patent
Shvedov

(10) Patent No.: US 8,955,845 B2
(45) Date of Patent: Feb. 17, 2015

(54) NOVELTY DEVICE FOR COMMUNICATION BETWEEN A HUMAN BEING AND UNIVERSAL CONSCIOUSNESS

(71) Applicant: Alexander Shvedov, London (CA)

(72) Inventor: Alexander Shvedov, London (CA)

( * ) Notice: Subject to any disclaimer, the term of this patent is extended or adjusted under 35 U.S.C. 154(b) by 0 days.

(21) Appl. No.: 13/691,778

(22) Filed: Dec. 1, 2012

(65) Prior Publication Data

US 2013/0093137 A1 Apr. 18, 2013

(51) Int. Cl.
*A63F 9/18* (2006.01)
*A63F 9/24* (2006.01)

(52) U.S. Cl.
CPC ..... *A63F 9/181* (2013.01); *A63F 2009/2447* (2013.01); *A63F 2009/2452* (2013.01); *A63F 2250/489* (2013.01)
USPC ..... 273/161

(58) Field of Classification Search
USPC ..... 273/161, 449, 450; 177/190, 193, 194; 434/194
See application file for complete search history.

(56) References Cited

U.S. PATENT DOCUMENTS 784,145 A * 3/1905 Donecker ..... 434/194
2,827,298 A * 3/1958 Peters ..... 273/161
3,000,114 A * 9/1961 Konstantin ..... 434/194
3,478,466 A * 11/1969 Conner ..... 273/456
3,589,723 A * 6/1971 Glass et al. ..... 273/450
3,614,106 A * 10/1971 Morrison et al. ..... 273/156
3,688,855 A * 9/1972 Walters ..... 177/196
3,707,290 A * 12/1972 Birnkrant ..... 273/141 A
3,785,647 A * 1/1974 Bender ..... 273/450
3,797,832 A * 3/1974 Benwell ..... 273/161
4,057,247 A * 11/1977 Morrison ..... 273/450
4,116,445 A * 9/1978 Forbes ..... 273/161
D275,627 S * 9/1984 Chan et al. ..... D6/514
4,625,819 A * 12/1986 O'Neill ..... 177/190
5,503,587 A * 4/1996 Mellen ..... 446/486
5,518,247 A * 5/1996 Robichaud ..... 273/236
5,873,195 A * 2/1999 Wortham ..... 47/39
5,927,989 A * 7/1999 Kung et al. ..... 177/190
D416,409 S * 11/1999 Matthews et al. ..... D6/514
8,172,187 B2 * 5/2012 Felknor et al. ..... 248/188

* cited by examiner

*Primary Examiner* — Steven Wong

(57) ABSTRACT

Novelty device for communication between a human being and universal consciousness (Universal Mind) is a mechanical device with a Central body, suspended on several substantially upright supports, so that the Central body can move (swing) in horizontal plane. The upright supports are attached to a stationary frame. A diagram is attached to the same stationary frame. The diagram displays symbols, numbers, pictures and the like. A clear transparent surface with a colored dot indicator is attached to the moving Central body. In communication, the user holds the frame in his or her hands, observes the movements of the dot indicator over the diagram and interprets the dialog.

1 Claim, 4 Drawing Sheets

NOVELTY DEVICE FOR COMMUNICATION BETWEEN A HUMAN BEING AND UNIVERSAL CONSCIOUSNESS

BACKGROUND OF THE INVENTION

1. Field of Invention

Within current patent classification this invention pertains to the field of amusement devices. In the same time, this device may be useful in the field of personal research and also science-based research into communication with universal consciousness (Universal Mind).

2. Background Art

Throughout known history and on all continents, people have been curious, interested and desiring to obtain information from sources that cannot be seen or touched. For that people have been using many different devices. For example dowsing pendulums, dowsing (divining) rods, divining twigs, Lecher antennas, planchettes and Ouija boards. In all of the examples the user observes movements of the devices or their parts and interprets the movements with certain meaning.

Each of these devices has essential drawbacks, here are some of them: lack of precision and certainty of movements (pendulums), narrow area of application (dowsing), requires more than one person to use (planchettes, Ouija).

BRIEF SUMMARY OF THE INVENTION

The intention for this invention is to reliably obtain versatile knowledge from, or to have a pleasant, meaningful dialog with, high level source such as universal consciousness (universal mind, cosmic consciousness) by means of a simple mechanical device.

Based on prior art, such a device must have a moving part to it and if the movements are to be reliably and easily interpreted, than the moving part (Central body) must be suspended within a hand-held frame (a "showcase").

In this version of the device, the movements can be referenced to the frame and not to surrounding objects or the environment.

This novelty also brings forth the following advantages:

1. The movements are not obstructed by the hands of the user because the new device is held by the sides of the outer frame.
2. The device does not require any piece of furniture with flat surfaces for its use.
3. Following individual preferences, the device can be manufactured as big as a suitcase or as small as a pocket book.
4. Central body of the invention is suspended on a number of supports, therefore it can be anything or any combination of things of any material, form, shape and size or any number of pieces arranged as a pattern on a platform.
5. Appropriate diagram can be attached to a static outer frame and a clear transparent plastic with a colored dot indicator can be attached to the moving part (Central body). The diagram displays appropriate symbols in specific order. When the Central body moves, the dot indicator moves accordingly over the diagram, this allows for easy and accurate interpretation of the dialog or message.
6. Motion sensor(s) can be attached to the outer frame or other parts of the device. The motion sensor(s) generate(s) electrical signals (codes) correlating to the movements of the Central body. The signals (codes) can be processed by computer or other equipment for richer, more accurate and easy communication.

DETAILED DESCRIPTION OF THE PREFERRED EMBODIMENTS

Reference will now be made in detail to two preferred embodiments of device for communication between a human being and universal consciousness, the examples are illustrated with the accompanying drawings.

Figure 1:
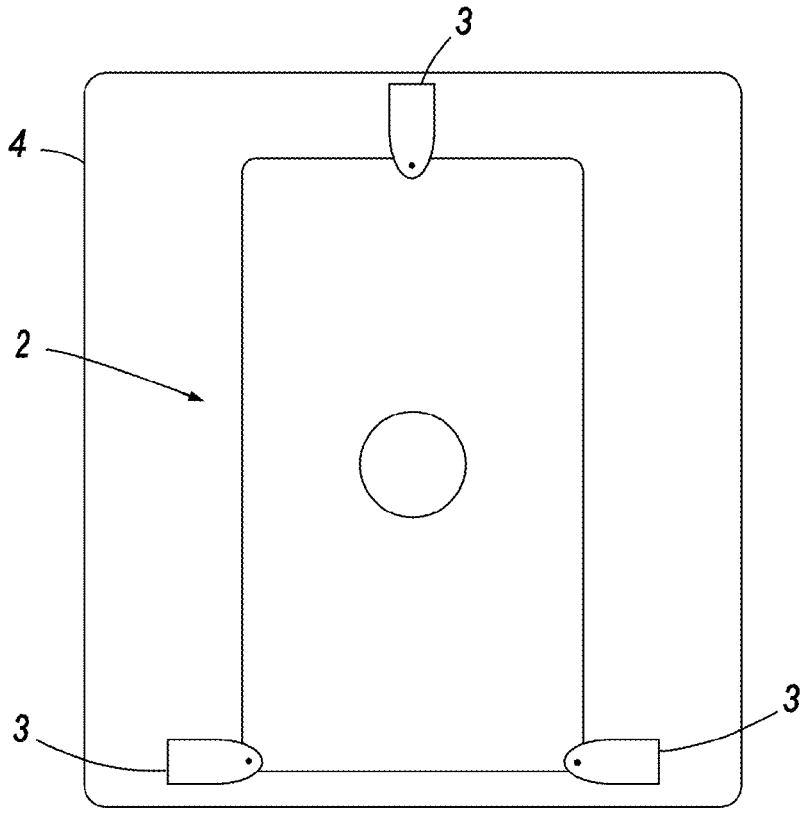
FIG. 1 Top plan view of the simplest embodiment of the device.
Figure 2:
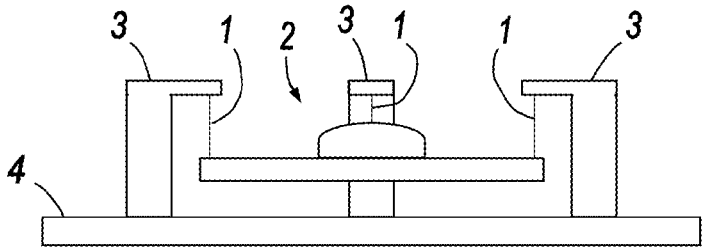
FIG. 2 Side view of the simplest embodiment of the device.
Figure 3:
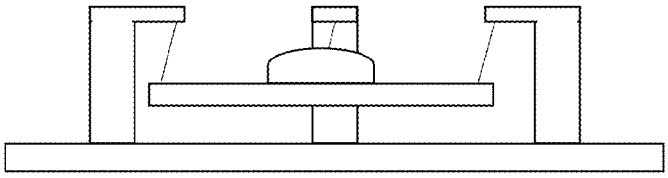
FIG. 3 Side view of the simplest embodiment of the device when Central body moves.

The simplest embodiment of the device can be seen in FIG. 1, FIG. 2 and FIG. 3. Components of the simplest embodiment are designated with numerals and are shown in their relationship on top plan view FIG. 1 and side view FIG. 2.

The Central body 2 comprises a piece of sheet plastic (Acrylic, PVC, ABS . . . ) of rectangular shape and a round piece of some metal, glued in the center. These materials and shape for the Central body is an example, in practice it can be any other materials and shapes.

The Central body 2 is suspended on three substantially upright supports 3 by means of three flexible hanging members 1, which can be threads, strings, filaments, lines, wires, chains, rods or bars (flexibly attached). Threads, for example, can be attached using through-hole fastening.

The substantially upright supports 3 as shown in FIG. 2 and FIG. 3 are manufactured in such a shape that it allows for the Central body 2 to move (swing) in horizontal plane and they are attached to the outer frame 4 with glue. The outer frame 4 is a rectangular piece of sheet plastic.

The user holds the outer frame 4 in his or her hands, observes and interprets the movements of the Central body 2. FIG. 3 shows side view of the simplest embodiment when the Central body moves. All threads are at an angle.

Figure 4:
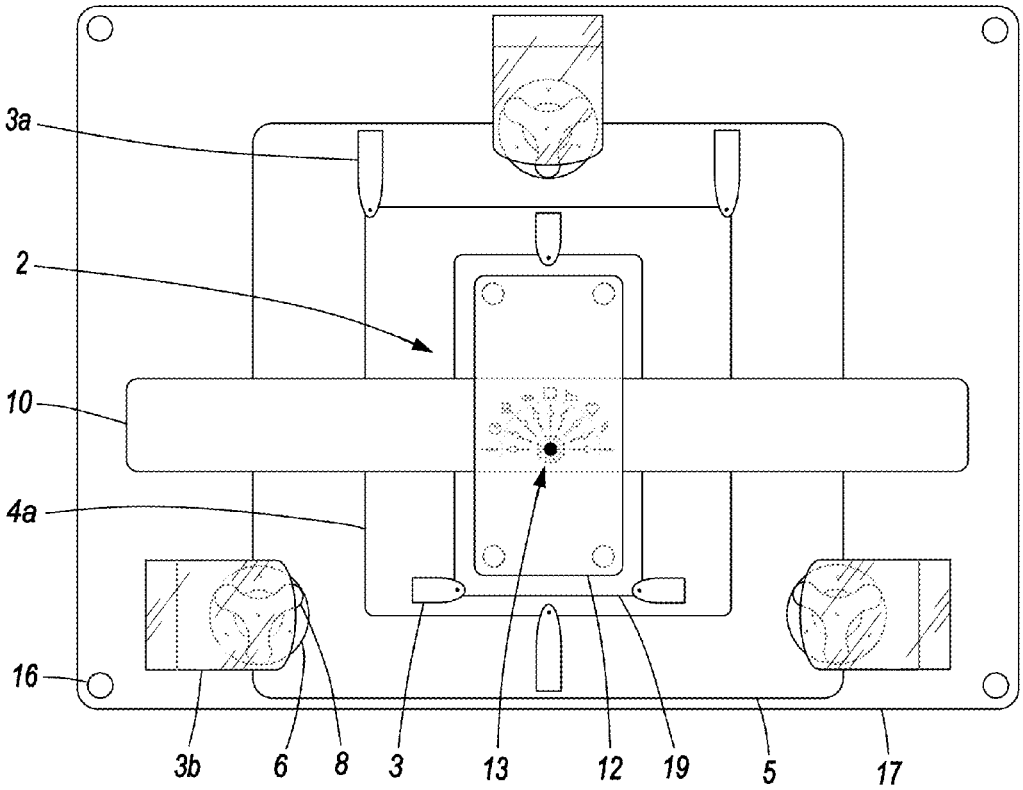
FIG. 4 Top plan view of the preferred embodiment of the device.
Figure 5:
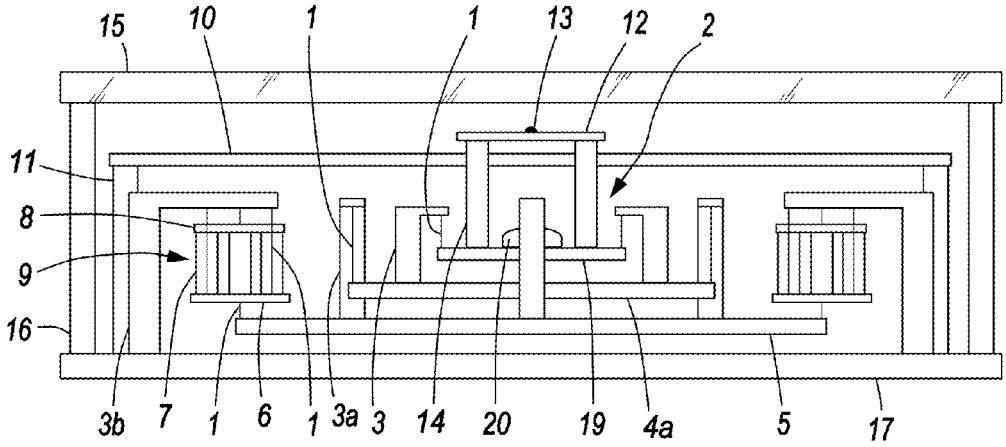
FIG. 5 Side view of the preferred embodiment of the device.
Figure 6:
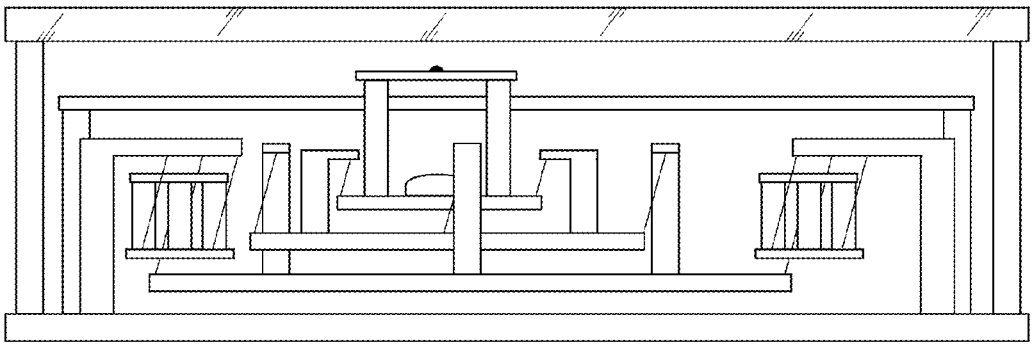
FIG. 6 Side view of the preferred embodiment of the device when Central body moves.

Another, better, preferred embodiment is shown in detail in FIG. 4, FIG. 5, and FIG. 6.

As you can see, Central body 2 of this embodiment comprises a piece of sheet plastic 19 of rectangular shape and a round piece of some metal 20. Additionally, four upright round plastic spacers 14 are attached to plastic 19 and a piece of clear transparent sheet plastic 12 is attached to upper ends of the spacers 14. A colored dot 13 is imprinted in plastic 12 in the center.

The central body 2 is suspended on three supports 3 by means of three threads 1, and the supports 3 are attached to primary frame 4*a*. The primary frame 4*a*, in turn, is suspended on three supports 3*a* by means of three threads 1. The supports 3*a* are manufactured same shape but larger in size than supports 3. The three supports 3*a* are attached to secondary frame 5.

Frames 4*a* and 5 are manufactured as rectangular pieces of sheet plastic of suitable size. Secondary frame 5, in turn, is suspended by means of three threads 1, hanging from subassembly 9. All supports are attached to the frames with glue.

9 is an example of possible proprietary frame subassembly where 8 is an upper fan-shaped plastic, 6 is a plastic ring, 7 is one of three round plastic spacers. Parts 8, 6 and 7 are glued together. The subassembly 9 is suspended from plastic support 3*b* on three threads 1, and one thread 1 in the center holds frame 5.

Three larger supports 3*b* are manufactured in such a shape and size so that this allows for subassembly 9, and the whole mechanism to move (swing) in horizontal plane. In top view FIG. 4 supports 3*b* are shown as manufactured out of clear transparent plastic.

10 is an elongated rectangular piece of sheet plastic with a symbolic diagram attached to it. This plastic 10 is attached to four upright plastic spacers 11 and the lower ends of spacers 11 are attached to outer frame 17. Plastic 10 is positioned ⅛ inch (3 mm) below transparent plastic 12 and so, that colored dot 13 is seen over the center of the diagram.

15 is a rectangular piece of clear glass, which can be held by the hands of the user and it also protects the mechanism while the device is in use. The glass 15 is attached to four upright plastic spacers 16 and the lower ends of the spacers 16 are attached to the outer frame 17. The glass 15 is not shown in top plan view FIG. 4 in order not to obstruct good visibility of the mechanism. 17 is a rectangular piece of sheet plastic which serves as the outer frame for the device.

All parts of this device are attached to each other by means of glue and all threads are attached by through-hole fastening.

FIG. 6 shows side view of this invention when Central body moves. All threads are at an angle. Multiple frames produce greater amplitude of movements/swing compared with single outer frame.

Figure 7:
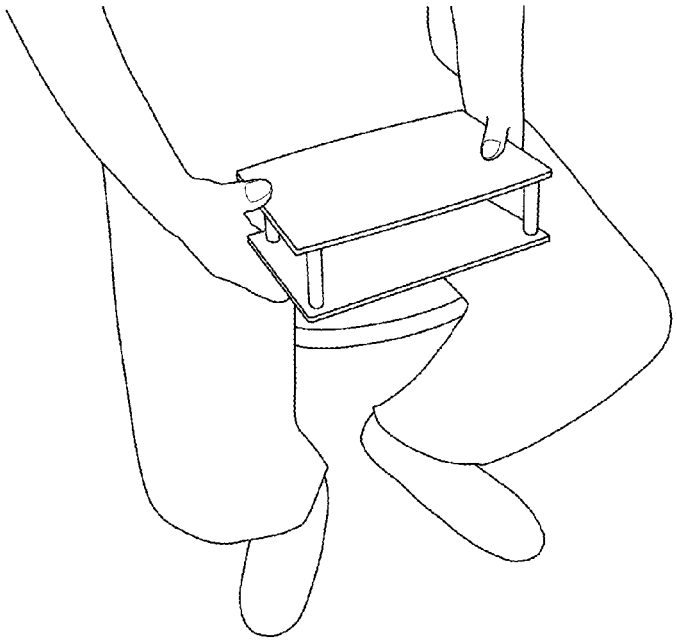
FIG. 7 Perspective view of the device in use. The user is seated.
Figure 8:
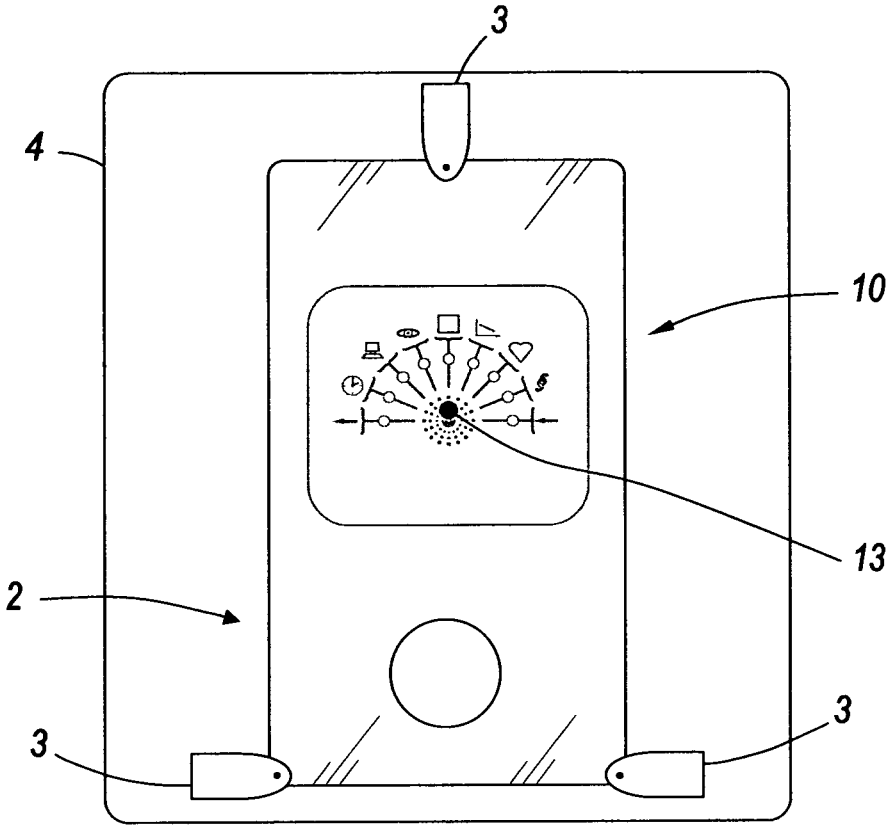
FIG. 8 Top plan view of the simplest embodiment with a diagram.
Figure 9:
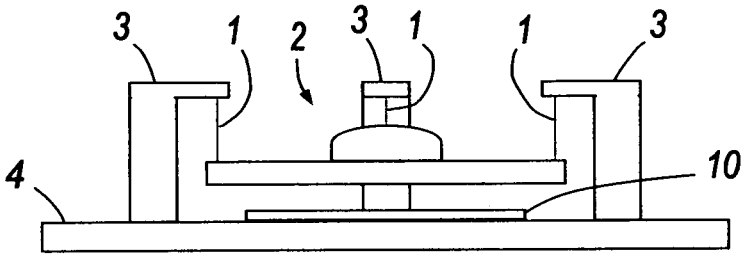
FIG. 9 Side view of the simplest embodiment with a diagram.
Figure 10:
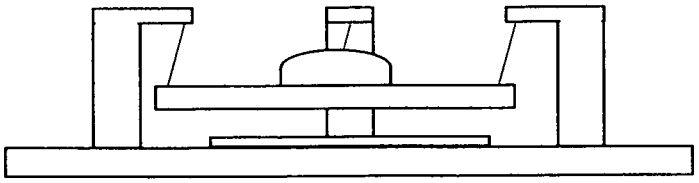
FIG. 10 Side view of the simplest embodiment with a diagram when central body moves.

FIG. 7 is a perspective view of this invention in use. The user, while seated, holds the device in his or her hands, observes and interprets the movements of the dot indicator over the diagram.

The above-presented description and illustrations constitute the disclosure of Novelty device for communication between a human being and universal consciousness.

Form, size, method of attachment and material of the components may vary as long as it allows for the mechanism to move (swing) in substantially horizontal plane.

For further protection and convenience, the entire mechanism can be housed in nice, rugged enclosure.

What is claimed is:

1. Novelty device for communication between a human being and universal consciousness, which is a mechanical device, comprising an outer frame, formed to enclose the device and to be held by a user, a plurality of substantially upright supports, attached to said outer frame, a diagram, displaying symbols and said diagram is attached to said outer frame, a central body, which is a clear transparent sheet material, having a dot at the center; said central body is suspended on said supports by a plurality of flexible hanging members; said central body and said supports are formed in such a manner that said central body is free to move over said diagram in a horizontal plane; wherein the user holds said outer frame in his or her hands, sees and interprets movements of the dot relative to the symbols of the diagram.

* * * * *